US006791244B2

(12) United States Patent
Linssen

(10) Patent No.: US 6,791,244 B2
(45) Date of Patent: Sep. 14, 2004

(54) ELECTRIC LAMP PROVIDED WITH A LAMP CAP

(75) Inventor: Petrus Johannes Antonius Linssen, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 41 days.

(21) Appl. No.: 10/056,120

(22) Filed: Jan. 24, 2002

(65) Prior Publication Data

US 2002/0158560 A1 Oct. 31, 2002

(30) Foreign Application Priority Data

Jan. 30, 2001 (EP) ..... 01200318

(51) Int. Cl.[7] ..... H01J 5/50; H01J 5/52; H01J 5/60

(52) U.S. Cl. ..... 313/51; 313/49; 313/50; 313/318.1; 313/318.09; 439/234; 439/226; 439/611; 439/619

(58) Field of Search ..... 313/49, 50, 51, 313/318.09, 318.01, 318.05, 318.1; 439/234, 226, 611, 619, 617, 739

(56) References Cited

U.S. PATENT DOCUMENTS

| | | | | | |
|---|---|---|---|---|---|
| 3,197,668 | A | | 7/1965 | Horan | 313/318 |
| 3,859,554 | A | * | 1/1975 | Preziosi et al. | 439/617 |
| 4,246,632 | A | * | 1/1981 | Hancox | 362/382 |
| 4,947,082 | A | * | 8/1990 | French | 313/318.07 |
| 5,078,625 | A | * | 1/1992 | Anzai | 439/699.2 |
| 5,172,026 | A | * | 12/1992 | Hall et al. | 313/318.1 |
| 5,250,874 | A | | 10/1993 | Hall et al. | 313/318 |
| 5,513,082 | A | | 4/1996 | Asano | 362/226 |

FOREIGN PATENT DOCUMENTS

| | | | |
|---|---|---|---|
| DE | 4405760 A1 | 8/1995 | H01H/9/18 |
| WO | WO9952128 | 10/1999 | H01K/1/46 |

* cited by examiner

*Primary Examiner*—Nimeshkumar D. Patel
*Assistant Examiner*—Mariceli Santiago

(57) ABSTRACT

An electric lamp (2) with a lamp cap (12) suitable for contacting an external electric contact element (28). The lamp cap comprises contacting means (16) comprising a first contact part (18) connected to a second contact part (20) via a spring (24), thus enabling the second contact part (20) to move transversely with respect to the first contact part (18) and/or the lamp cap (12). Optionally, the first contact part (18) is kept in a fixed position with respect to the lamp cap (12) through the spring force of a further spring (22).

6 Claims, 2 Drawing Sheets

ELECTRIC LAMP PROVIDED WITH A LAMP CAP

The invention relates to an electric lamp provided with a lamp cap suitable for contacting an external contact element, which lamp cap is connected to a lamp vessel, and which lamp cap comprises a housing and contact members connected to current conductors of the lamp.

Such an electric lamp with lamp cap is known from WO 99/52128. The known lamp is suitable for being mounted on a carrier, for example a plate or a reflector. The known lamp is highly suitable for use as a motor vehicle headlamp. Car set makers demand that the actions to be performed during the assembling of car components, such as lighting units for motor vehicles, should be as simple as possible. A further wish is that car components should be universally applicable and uniform, i.e. independent of the assembling method such as, in the case of lamps, plate, front, and back mounting. The known lamp should accordingly be designed such that it can be placed against a carrier with the bulb facing forward (back or plate mounting) or with the lamp cap facing forward (back mounting), as desired. The lamp is then retained on the carrier by additional means.

A problem during mounting of the known electric lamp with lamp cap on the carrier is the possible occurrence of a comparatively large spread in the dimensions of and mutual distances between contact elements on the carrier to which the lamp with lamp cap is to be coupled. This involves the disadvantage on the one hand that assembling of the lamp on the carrier is difficult and that there is an increased risk of the lamp or carrier being rejected. If an accurate dimensioning is desired, on the other hand, comparatively high expenses are often to be incurred for achieving accurate dimensions of the contact elements and their mutual distances.

It is an object of the invention to provide an electric lamp fitted with a lamp cap of the kind described in the opening paragraph by which the above disadvantage is counteracted.

According to the invention, this object is achieved in that the contact members each comprise a spring, a first contact part, and a second contact part, which second contact part is connected to the first contact part via said spring for rendering the second contact part displaceable relative to the first contact part in a direction transverse to a mounting direction during contacting with the external contact element.

The problem mentioned above with respect to the mounting of the electric lamp with lamp cap according to the invention on the carrier is counteracted by the displacement possibility of the second contact part in a direction transverse to a mounting direction of the lamp with lamp cap on the carrier. The mounting direction is that direction in which the second contact part and the external contact element are displaced relative to one another in the process of achieving a mutual contact. Such a displacement usually occurs during contacting of the lamp cap with the external contact element of the carrier, for example a plate. The external contact elements may then have a mutual interspacing which is different from the initial interspacing of the two contact members, for example in that the external contact elements are positioned too far apart from one another or too close together. Such a displacement may also occur during the insertion of a lamp with lamp cap mounted on a plate into a reflector, where the reflector has a difference in positioning with respect to the plate. The springs render it possible to compensate said difference so that, in spite of this difference in positioning, the lamp with lamp cap can yet be placed on the carrier. Among the springs suitable for compensating this difference are blade springs, U-shaped springs and helical springs. It was found that the assembling process is simplified by the springs because the alignment can take place with less accuracy. At the same time, the reject percentage is reduced because the carrier, the reflector, and the lamp with lamp cap were found to fit each other in spite of the mutual positioning and/or distance differences mentioned above. It was further found that comparatively high expenses could be avoided which used to be necessary for achieving an accurate dimensioning and positioning of the carrier, reflector, and lamp with lamp cap.

In an embodiment, the first contact part, the second contact part, and the spring integrally constitute the contact member. The contact member forms the electrical connection between the current conductors of the lamp and the external contacts on the carrier. The contact member may be built up from several components which are subsequently joined together into an integral unit, in which case it is possible to provide the first contact part, the second contact part, and the spring with the respective desired specific mechanical and/or physical characteristics. The first and the second contact part may be provided with, for example, a layer which counteracts corrosion, whereby the risk of an impaired electrical contacting with external contact elements during product life is reduced, while the spring may be given improved elastic properties such that the probability of a good resilience thereof during product life is increased. Alternatively, the contact member may be manufactured as an integral whole, which means that this contact member can be manufactured in a comparatively simple and inexpensive manner.

In an alternative embodiment, the first contact part in the lamp is provided with a further spring for keeping the first contact part positioned against the housing under a comparatively high spring pressure. In such an embodiment, the mechanical load arising during the transverse displacement of the second contact part relative to the first contact part is absorbed in the force with which the further spring keeps the first contact part positioned against the housing. This embodiment as a result has the advantage that the contact between the contact member and the respective current conductor remains unloaded, which reduces the risk of this contact being prematurely broken and of lamp life being prematurely ended.

In a further embodiment, the second contact part of the electric lamp is provided with resilient guiding clamps. Mounting of the lamp with lamp cap on the carrier is even further simplified thereby. The guiding clamps allow a greater spread in the initial positioning of the lamp with lamp cap with respect to the carrier because they effect a wider range in self-alignment and self-positioning of the contact members and the contact elements. Preferably, the guiding clamps are provided with a tag for further enhancing the self-alignment and self-positioning range.

Embodiments of the electric lamp according to the invention are diagrammatically shown in the drawing, in which.

Figure 1:
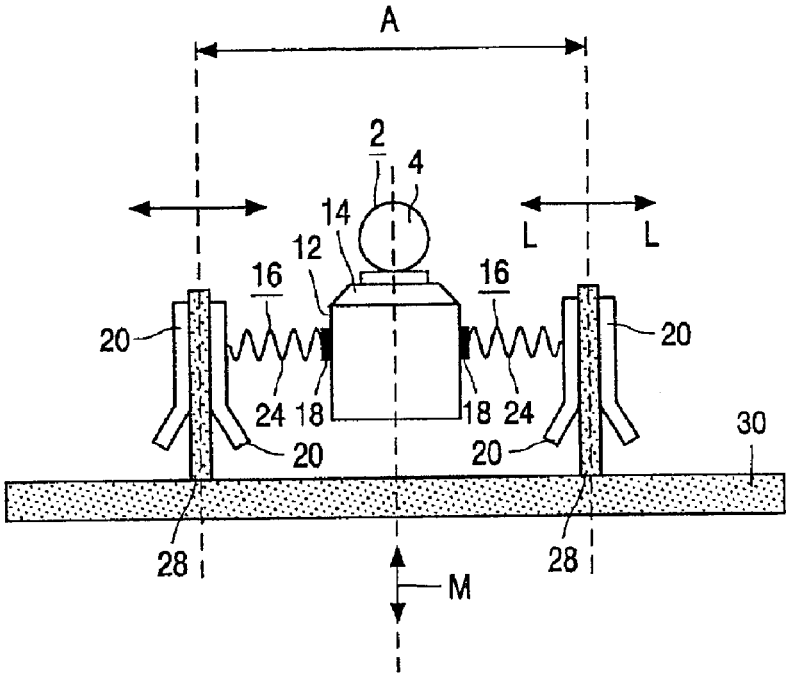
FIG. 1 shows a lamp with lamp cap in side elevation on a carrier.

FIG. 1 shows the electric lamp 2 provided with a lamp cap 12 which is connected to the lamp vessel 4. The lamp cap 12 comprises a housing 14 and contact members 16 which are at a distance A from one another. The contact members 16 each comprise a spring 24, a first contact part 18, and a second contact part 20. The second contact part 20 is connected to the first contact part 18 via said spring 24 so as to render the second contact member 20 displaceable with respect to the first contact member 18 in a direction transverse to a mounting direction M over a distance of at most 2*L. A mutual a displacement of contact members 18 and 20 will usually take place during contacting of the lamp cap with the external contact element 28 of a carrier 30, for example a plate. The external contact elements 28 may then have a mutual interspacing which differs from the distance A between the two contact members 16, for example in that the two external contact elements 28 are placed too far from one another or too close together. The springs 24 render it possible to compensate this difference so that, in spite of the difference in interspacing, the lamp with lamp cap can nevertheless be placed on the carrier. In a practical realization of the embodiment of the lamp as described above, the lamp has the advantage that it has a comparatively small axial dimension of approximately 5.5 cm and is yet suitable for dissipating a comparatively high power of, for example, 5 to 25 W. The lamp then has an operational life of approximately 6000 hours.

Figure 2:
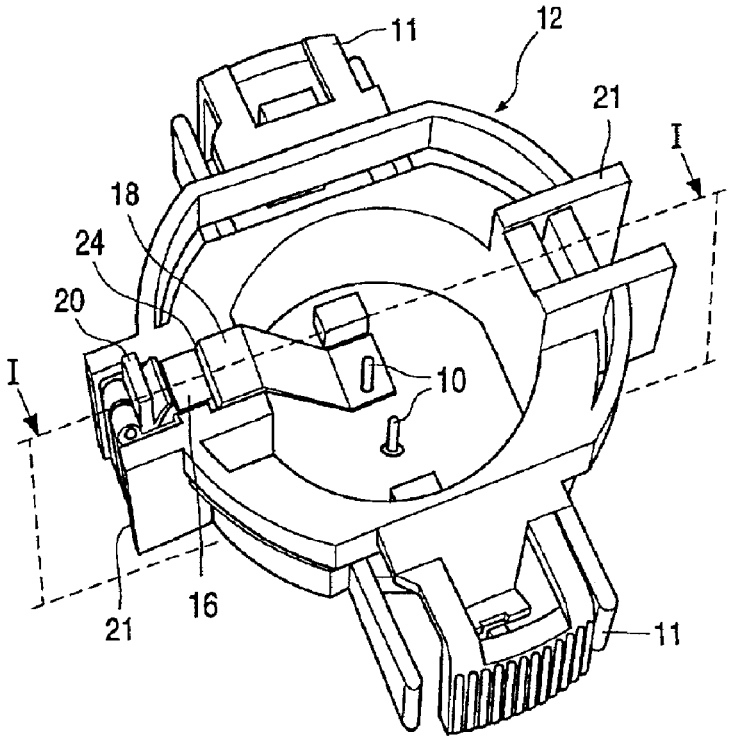
FIG. 2 shows the lamp cap of FIG. 1 with only one contact member, viewed obliquely from above.

FIG. 2 diagrammatically shows a lamp cap 12 in perspective view, provided with means 11 for mounting, pressing home, fixing, and removing the lamp with lamp cap on and from the carrier. The Figure shows only one contact member 16, having a first 18 and a second contact part 20 which are interconnected by a spring 24. Screenings 21 of the respective contact members 16 are also shown, with a recess 23 (see FIG. 3) into which a U-shaped spring of a contact member 16 can be inserted. A major portion of the lamp has been left out for the sake of clarity; only current conductors 10 of the lamp are shown, to one of which the contact member 16 is connected.

Figure 3:
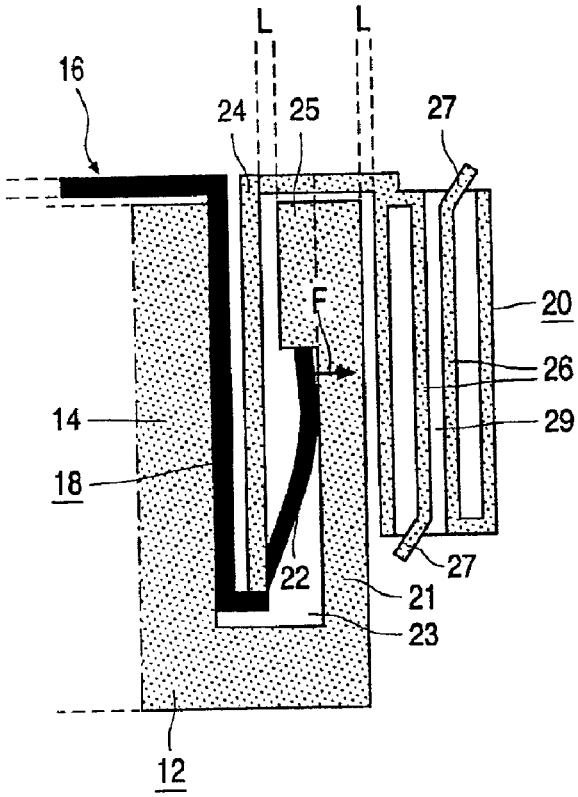
FIG. 3 is a partial lateral sectional view taken on the line I—I of the lamp cap of FIG. 2.
Figure 4:
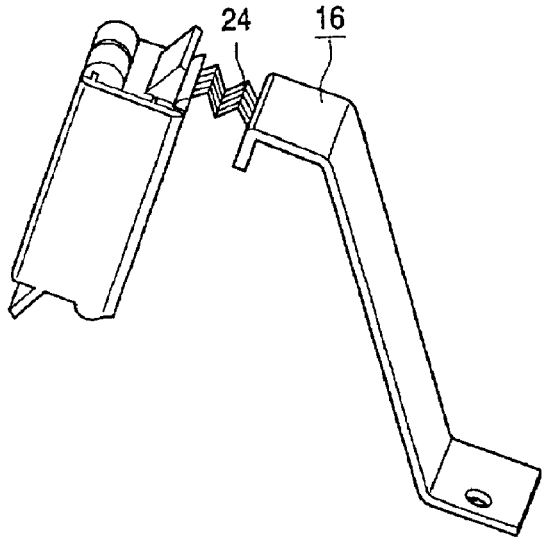
FIG. 4 shows an alternative embodiment of a contact member, viewed obliquely from above.

In FIG. 3, the contact member 16 on the lamp cap 12 as shown in FIG. 2 is manufactured from one integral piece. The contact member 16 is provided with a U-shaped spring 24, which spring 24 is inserted into the recess 23 of the screening 21 of the lamp cap 12. Alternatively, the spring 24 may have a different shape, for example a sawtooth shape as shown in FIG. 4. FIG. 3 further shows that the first contact part 18 of the contact member 16 is provided with a further spring 22 which exerts a force F on the screening 21 of the lamp cap 12, whereby the first contact part 18 is kept in position against the housing 14 of the lamp cap. After its insertion into the recess 23, moreover, this spring 22 hooks itself behind a raised portion 25 of the screening 21, so that the contact member 16 is locked to the lamp cap 12 and cannot be simply lifted off the lamp cap 12. The second contact part 20 of the contact member 16 is provided with resilient guiding clamps 26, each having a tag 27, between which an opening 29 is present into which an external contact can be introduced. The Figure further shows that the U-shaped spring 24 and the second contact part 20 are provided with a clearance L around the screening 21 of the lamp cap. This clearance L and the spring 24 render it possible for the second contact part 20 to be displaceable with respect to the first contact part 18 and the housing 14 in a direction transverse to the mounting direction.

What is claimed is:

1. An electric lamp (2) provided with a lamp cap (12) for contacting an external contact element (28), which is suitable for use with different respective carriers which respective carriers have external contact elements which are located at different respective spacings from said lamp when said lamp is in a mounting position on a carrier, which lamp cap (12) is connected to a lamp vessel (4) and which lamp cap (12) comprises a housing (14) and contact members (16) connected to current conductors (10) of the lamp (2), characterized in that the contact members (16) each comprise a spring (24), a first contact part (18) and a second contact part (20), which second contact part (20) is connected to the first contact part (18) via said spring (24) for rendering the second contact part (20) displaceable relative to the first contact part (18) in a direction transverse to a mounting direction during contacting with said external contact element (28) on a carrier to a degree sufficient to accommodate said different respective spacings at which said external contact elements (28) are located on respective carriers.

2. An electric lamp (2) as claimed in claim 1, characterized in that the first contact part (18), the second contact part (20), and the spring (24) integrally constitute the contact member (16).

3. An electric lamp (2) as claimed in claim 1, characterized in that the first contact part (18) is provided with a further spring (22) for keeping the first contact part (18) positioned against the housing (14) under a comparatively high spring pressure.

4. An electric lamp (2) as claimed in claim 1 characterized in that the second contact part (20) is provided with resilient guiding clamps (26).

5. An electric lamp as claimed in claim 1 wherein said spring is U-shaped and is located in a recess in said housing having recess walls, and wherein there is clearance between said spring and said second contact, and said recess walls to render said spring displaceable.

6. An electric lamp as claimed in claim 5 wherein the first contact part is provided with a further spring located in said recess for keeping the first contact part positioned against a recess wall under force from said further spring.

* * * * *